US008558096B2

(12) United States Patent
Altheim

(10) Patent No.: US 8,558,096 B2
(45) Date of Patent: Oct. 15, 2013

(54) GUITAR WITH REINFORCED NECK JOINT RESULTING IN THINNER BODY AND HEEL JOINT

(75) Inventor: Michael D Altheim, Temecula, CA (US)

(73) Assignee: Michael D. Aitheim, Temecula, CA (US)

( * ) Notice: Subject to any disclaimer, the term of this patent is extended or adjusted under 35 U.S.C. 154(b) by 48 days.

(21) Appl. No.: 12/800,840

(22) Filed: May 24, 2010

(65) Prior Publication Data

US 2011/0232458 A1 Sep. 29, 2011

Related U.S. Application Data

(60) Provisional application No. 61/217,143, filed on May 27, 2009.

(51) Int. Cl.
*G10D 3/02* (2006.01)

(52) U.S. Cl.
USPC ..... 84/293

(58) Field of Classification Search
USPC ..... 84/267, 290, 291, 293
See application file for complete search history.

(56) References Cited

U.S. PATENT DOCUMENTS

2007/0107579 A1* 5/2007 Babicz ..... 84/293

* cited by examiner

*Primary Examiner* — Kimberly Lockett

(57) ABSTRACT

A metal block that connects the bridge to the neck of a guitar. The block fits into a routed area of the body. The increased strength of the neck joint created by the metal block allows the heel portion of the lap joint where the body overlaps the neck to be considerable thinner then a conventional guitar. The thinner neck joint allows better access to the upper fret registers. Connecting the bridge to the neck joint with the metal body allows for better sustain.

4 Claims, 13 Drawing Sheets

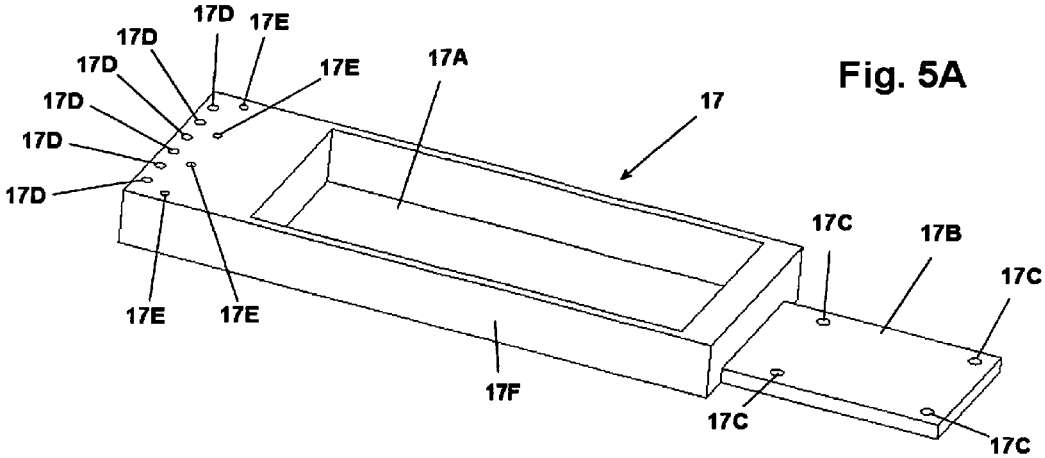
Fig. 5A
Fig. 5B
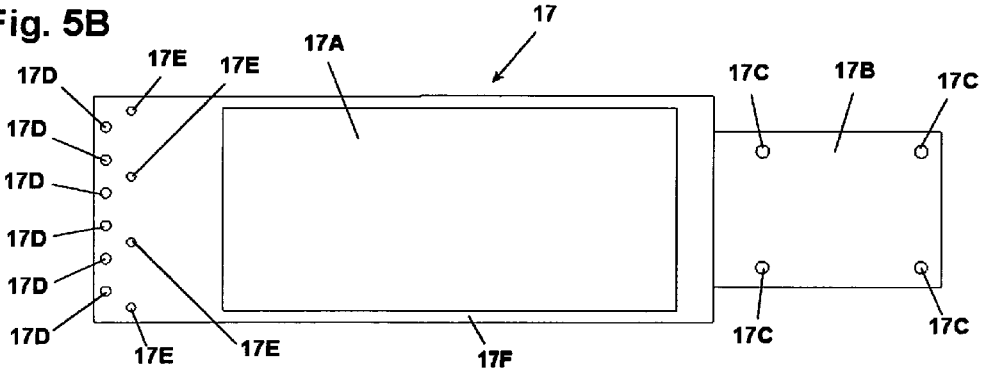
Fig. 5C
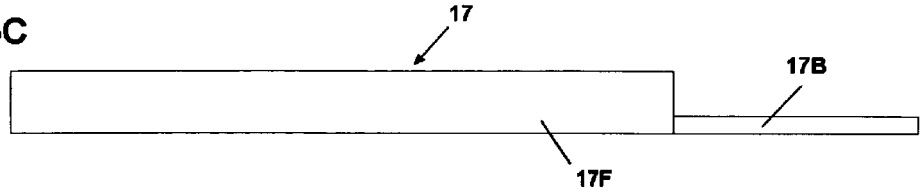
Fig. 5D
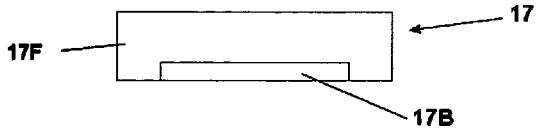

GUITAR WITH REINFORCED NECK JOINT RESULTING IN THINNER BODY AND HEEL JOINT

CROSS REFERENCE TO RELATED APPLICATIONS

This application claims the benefit of provisional patent application Ser. No. 61/217,143, filed May 27, 2009 by the present inventor.

BACKGROUND

1. Field

This application relates to the method and materials of attaching a guitar neck to a guitar body in a solid body guitar.

2. Prior Art

Conventional solid body guitars use a lap joint for to connect the neck to the body, where the neck overlaps a routed area, or neck pocket, in the body. The neck is either bolted or glued onto the body. To achieve strength in the joint, the heel, or the area of the body overlapping the neck, is relatively thick, impeding the access to the upper fret registers.

U.S. Pat. No. 5,452,637 to DeCola, September 1995, discloses a metal connector securing the neck and body together. This connector however does not connect the neck to the bridge of the guitar and still requires a thick body. The heel joint and only improves the access to the upper fret registers by contouring the heel of the body.

U.S. Pat. No. 4,939,970 to Hoshino and Nagoya, describes metal connector reinforcement of guitar neck joint. The connector has raised flanges on the neck and body sides that are received into grooves cut into the neck and body. This design does not thin the heel to improve upper fret access, nor does it connect the neck to the bridge.

U.S. Pat. No. 4,432,267 to Feller, February 1984, describes metal bar or block recessed into body that extends along one side of the neck with adjustable threaded fasteners to allow adjustments of the angle of the neck joint. The design intent was to allow adjustments of the neck angle and does not improve access to the upper fret registers.

U.S. Pat. No. 7,518,048 to Murray, April, 2009, describes a support bracket to connect neck and body. The design intent of the bracket is for aesthetic purposes such that none of the fasteners are visible on the outside. The design does not improve access to the upper fret registers and does not connect the neck to the bridge.

SUMMARY

A metal, or other high strength material, block or plate is fitted into a routed area of a guitar body connecting the body and neck together. The block reinforces the neck joint allowing a much thinner heel for better upper fret register access. Connecting the neck to the bridge with the block also increases sustain.

DRAWINGS

FIG. 1 is a top side perspective view of assembled guitar 16 according to the invention showing body top 18, body bottom 19, neck 20, neck plate 21, bridge 22, and bridge mounting screws 23.

FIG. 2 is a top side perspective, exploded view of guitar 16 in FIG. 1 showing body top 18, body bottom 19, block 17, neck 20, neck plate 21, neck mounting screws 26, bridge 22, bridge mounting screws 23, anchor block 24, and anchor block screws 25.

FIG. 3 is a bottom side perspective view of assembled guitar 16 according to the invention showing body top 18, body bottom 19, neck 20, neck plate 21, neck mounting screws 26, anchor block 24, and anchor block screws 25.

FIG. 4 is a bottom side perspective, exploded view of guitar 16 in FIG. 3 showing body top 18, body bottom 19, block 17, neck 20, neck plate 21, neck mounting screws 26, bridge 22, bridge mounting screws 23, anchor block 24, and anchor block screws 25.

FIG. 5A is a top side perspective view of block 17 showing main rectangular section of block 17F, holes drilled for strings 17D, bridge mounting holes 17E, hollowed out center section 17A, tongue 17B, and holes drilled for neck mounting screws 17C.

FIG. 5B is top view of block 17 showing main rectangular section of block 17F, holes drilled for strings 17D, bridge mounting holes 17E, hollowed out center section 17A, tongue 17B, and holes drilled for neck mounting screws 17C.

FIG. 5C is side view of block 17 showing main rectangular section of block 17F and tongue 17B.

FIG. 5D is front view of block 17 showing main rectangular section of block 17F and tongue 17B.

Figure 1:
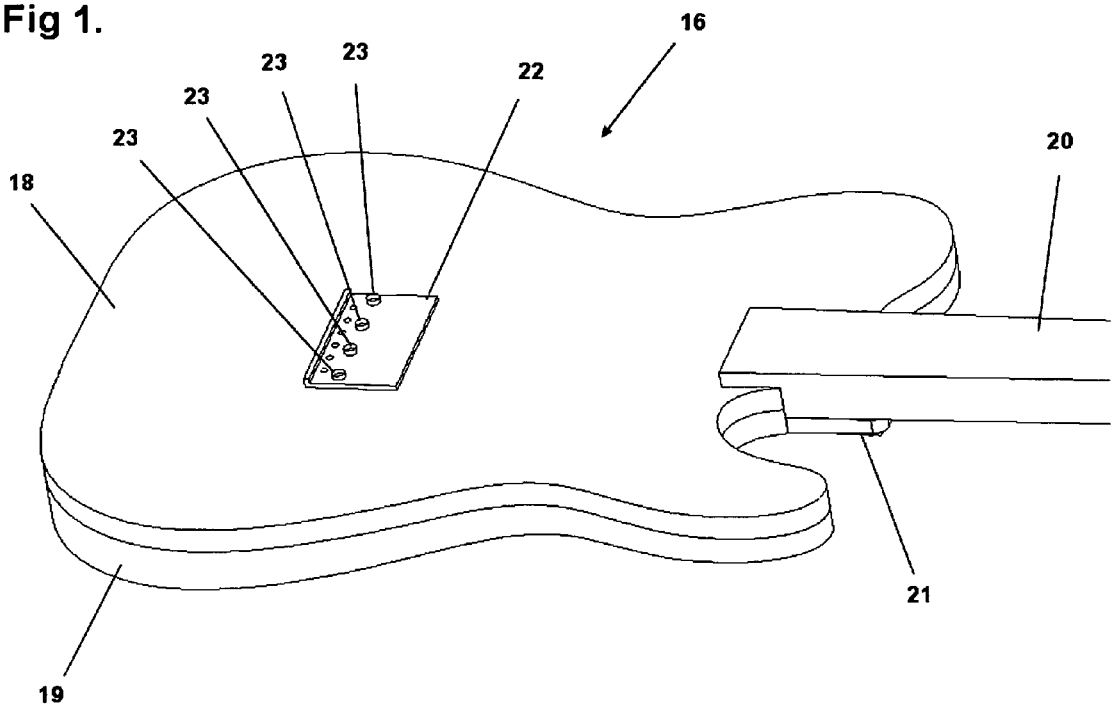
Figure 2:
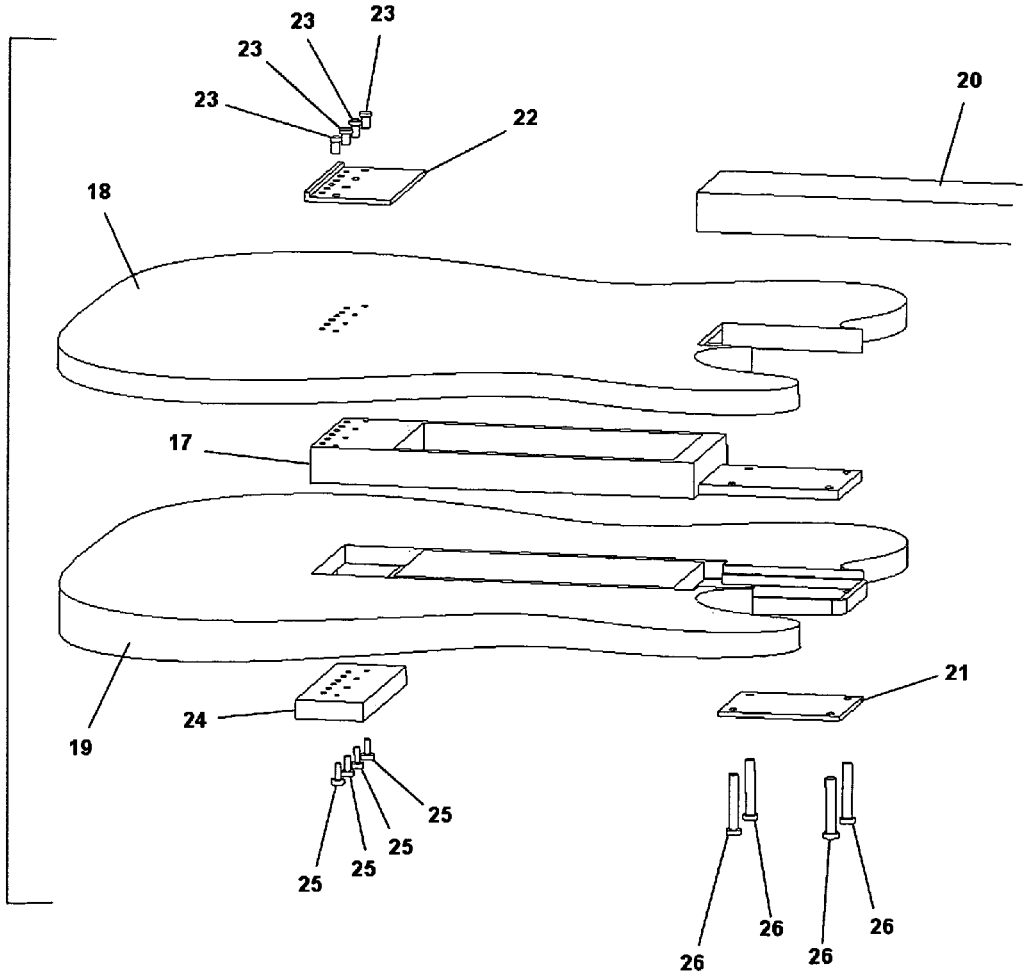
Figure 3:
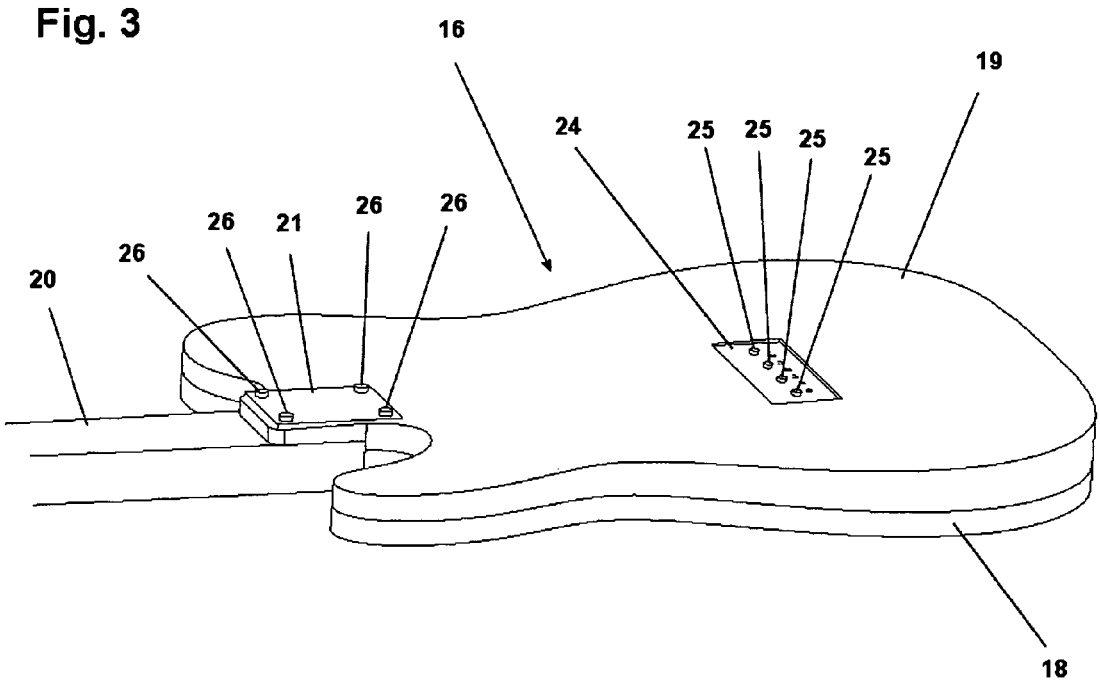
Figure 4:
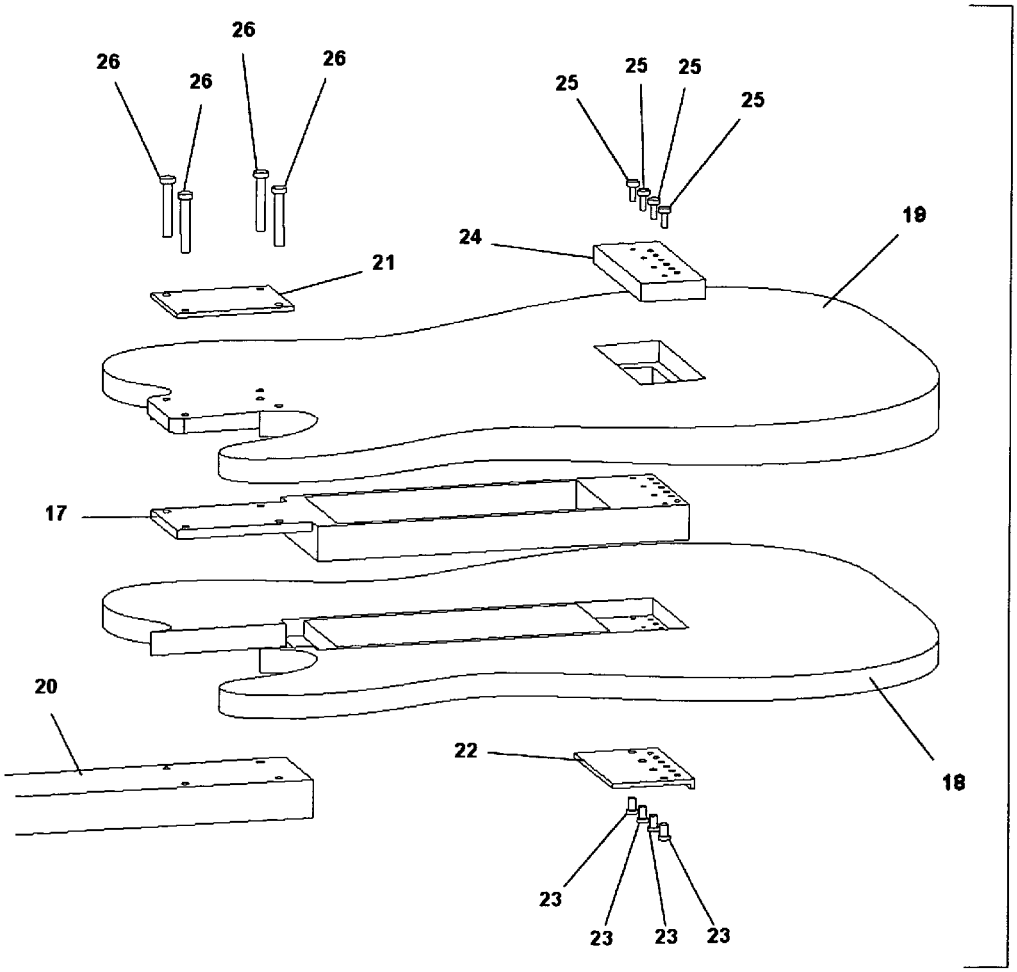
Figure 6:
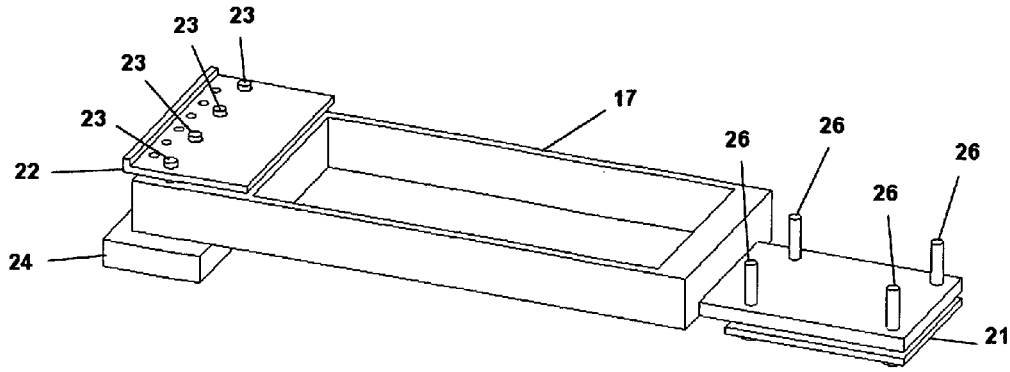

FIG. 6 is top side perspective view of assembled parts of guitar 16 according to the invention minus the body top 18, body bottom 19, and neck 20, showing block 17, neck plate 21, bridge 22, bridge mounting screws 23, neck mounting screws 26, and anchor block 24.

Figure 7:
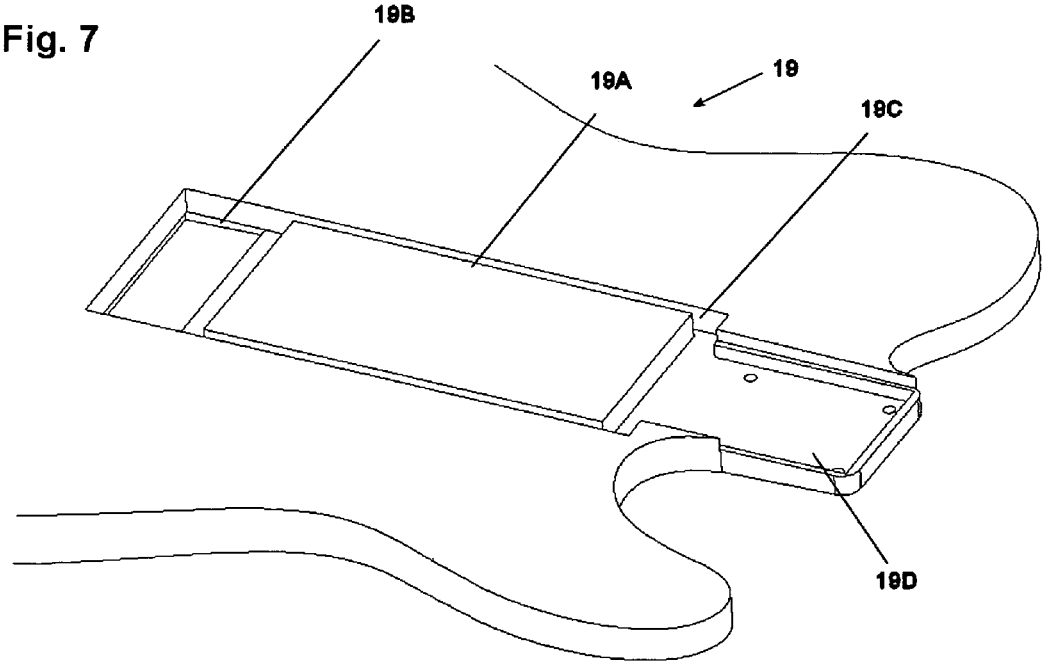

FIG. 7 is a top side perspective view of the body bottom 19 showing rear 19B, center 19C, and front 19D routed areas and the center of the routed area 19A that fills the hollowed out section 17A of the block 17.

Figure 8A:
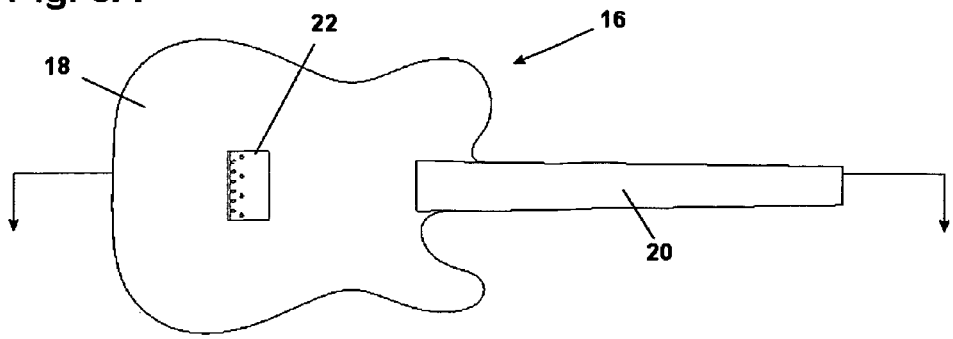
Figure 8B:
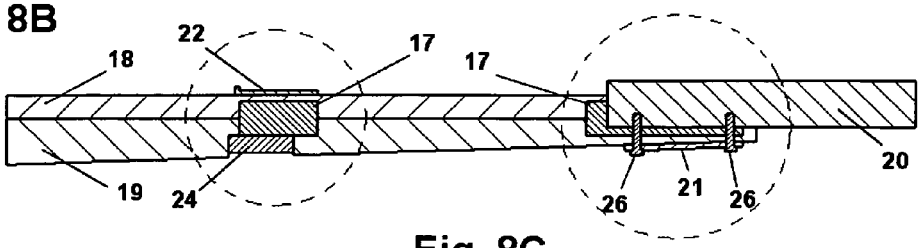
Figure 8C:
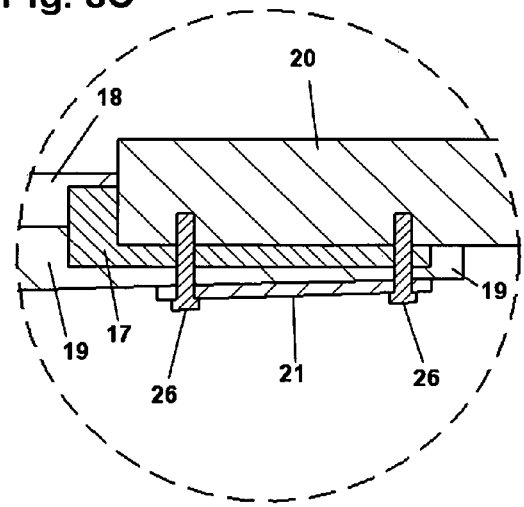
Figure 8D:
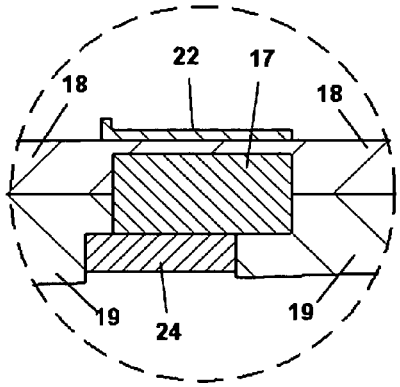

FIG. 8A is a top view of the guitar 16 according to the invention showing location of cross section views in FIGS. 8B-8D showing body top 18, neck 20, and bridge 22.

FIG. 8B is sectional view of guitar 16 through section defined in FIG. 8A showing body top 18, body bottom 19, block 17, neck 20, neck plate 21, neck mounting screws 26, bridge 22, and anchor block 24.

FIG. 8C is enlarged sectional view of the neck joint according to the invention showing body top 18, body bottom 19, block 17, neck 20, neck plate 21, and neck mounting screws 26.

FIG. 8D is enlarged sectional view of block 17, body top 18, body bottom 19, bridge 22, and anchor block 24.

Figure 9:
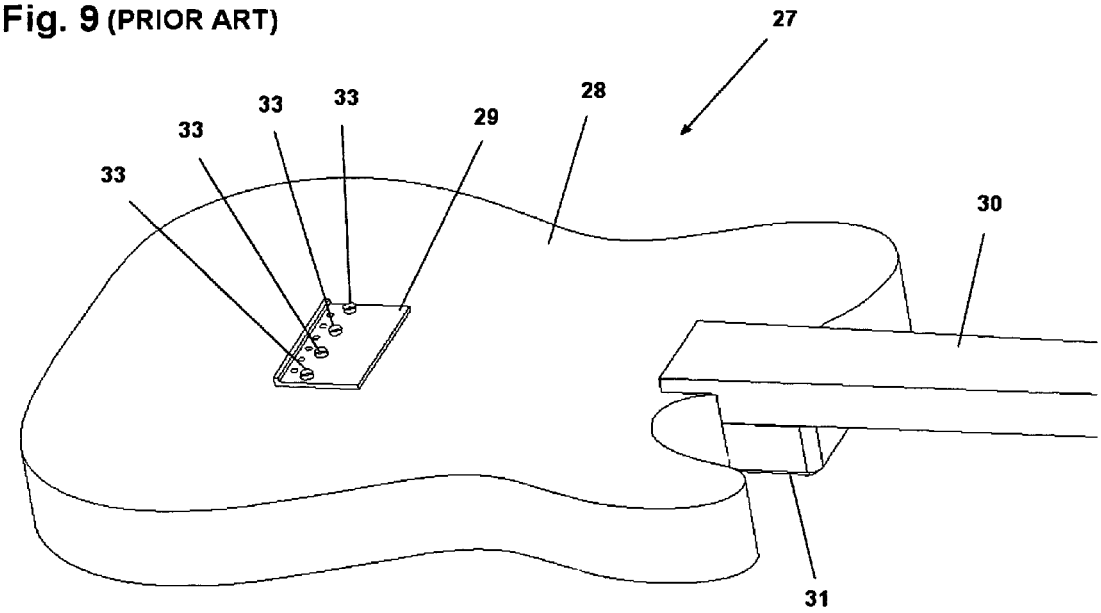
Fig. 9 (PRIOR ART)

FIG. 9 is top side perspective view of conventional guitar 27 (prior art) showing body 28, neck 30, neck plate 31, bridge 29, and bridge mounting screws 33.

Figure 10:
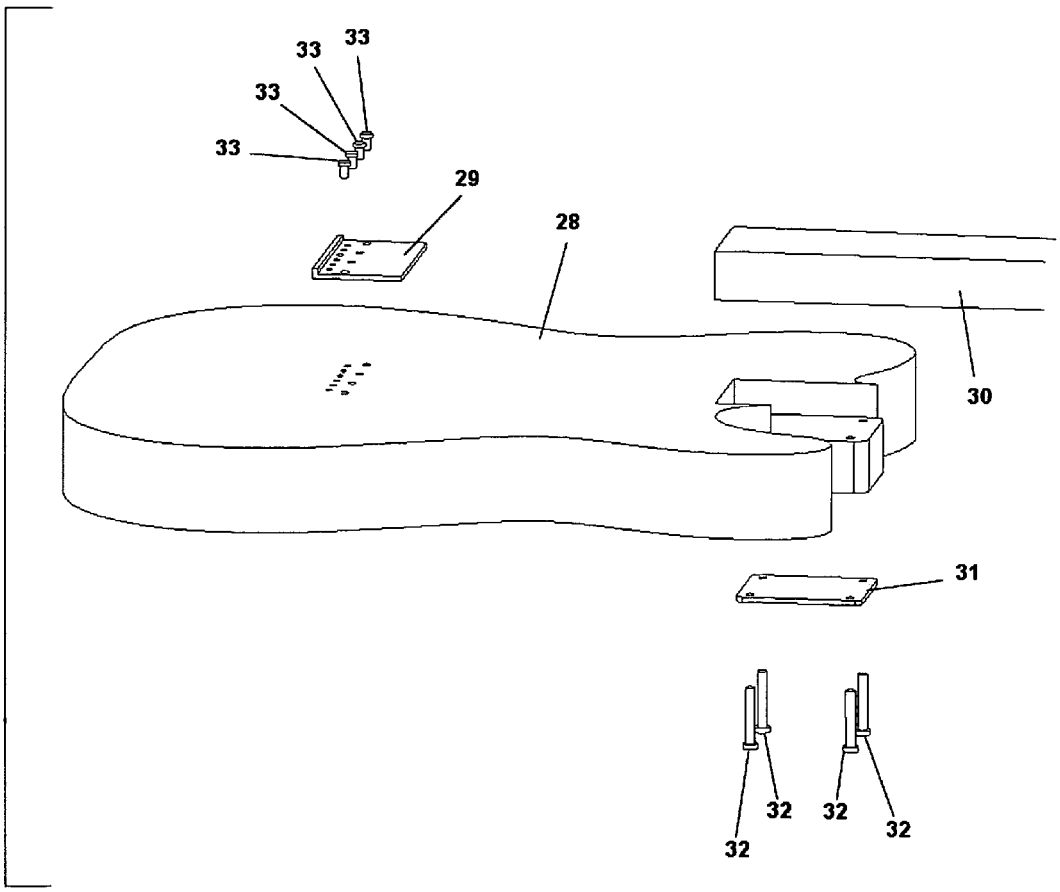
Fig. 10 (PRIOR ART)

FIG. 10 is a top side perspective, exploded view of conventional guitar 27 in FIG. 9 (prior art) showing body 28, neck 30, neck plate 31, neck mounting screws 32, bridge 29, and bridge mounting screws 33.

Figure 11:
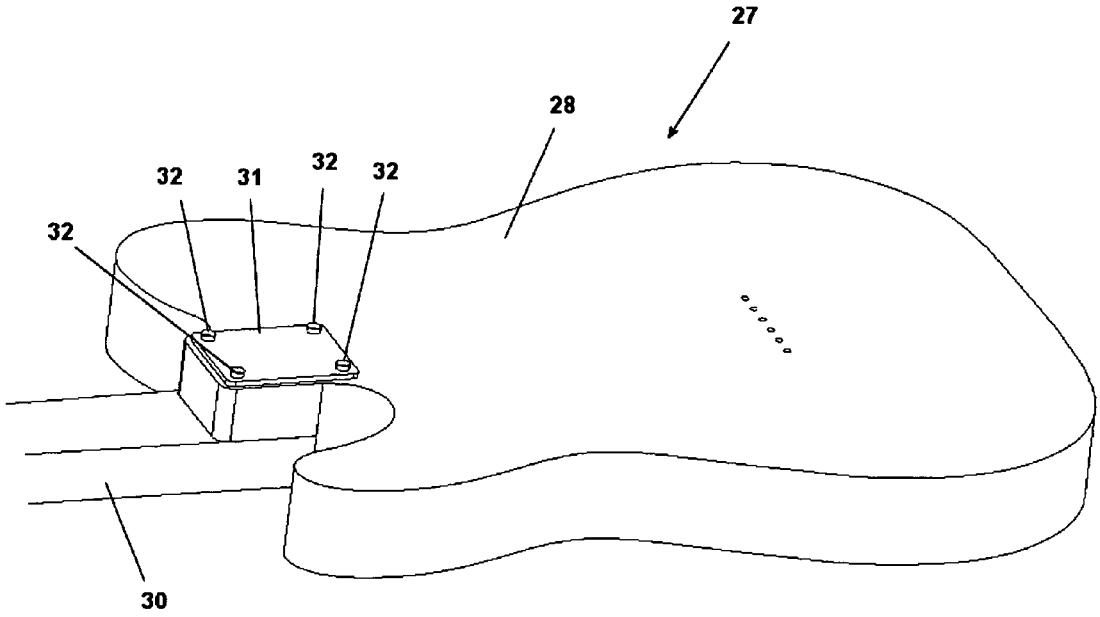
Fig. 11 (PRIOR ART)

FIG. 11 is bottom side perspective view of conventional guitar 27 (prior art) showing body 28, neck 30, and neck plate 31, and neck mounting screws 32.

Figure 12:
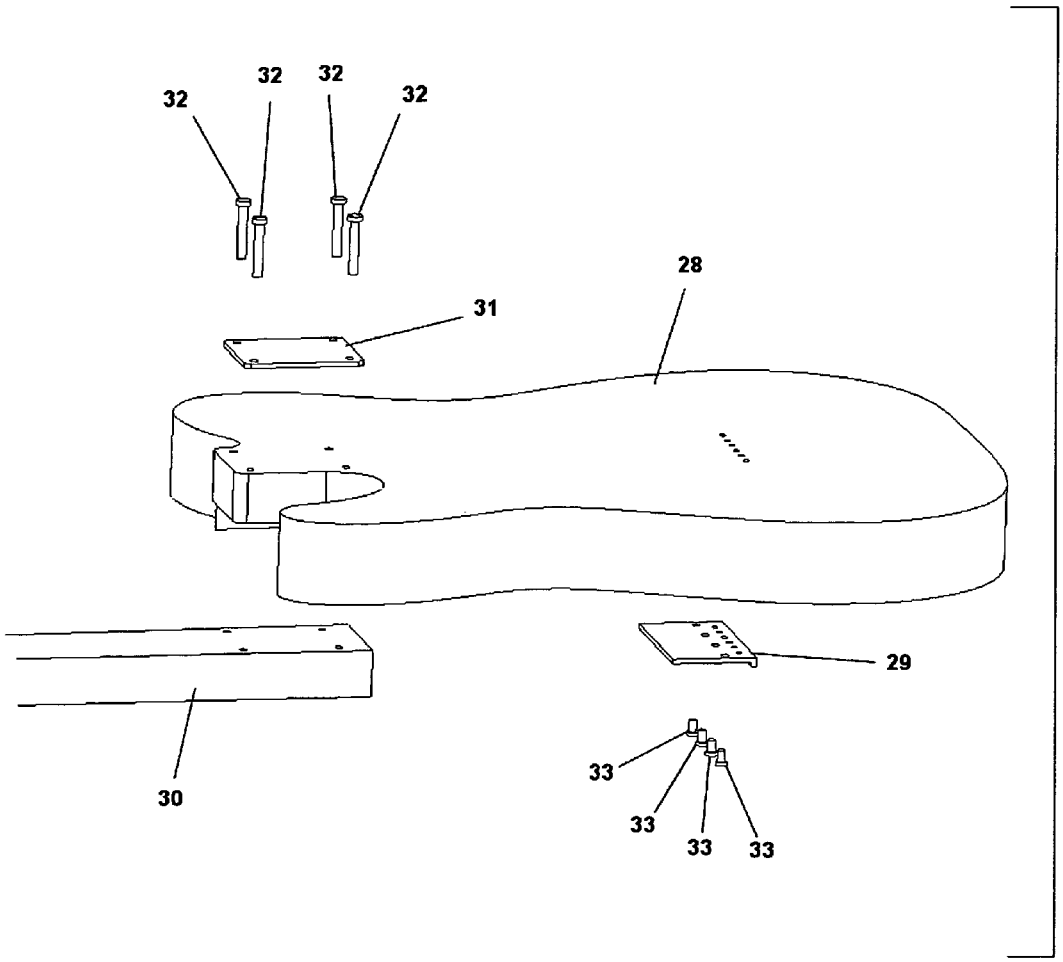
Fig. 12 (PRIOR ART)

FIG. 12 is bottom side perspective, exploded view of conventional guitar 27 in FIG. 11 (prior art) showing body 28, neck 30, neck plate 31, neck mounting screws 32, bridge 29, and bridge mounting screws 33.

Figure 13A:
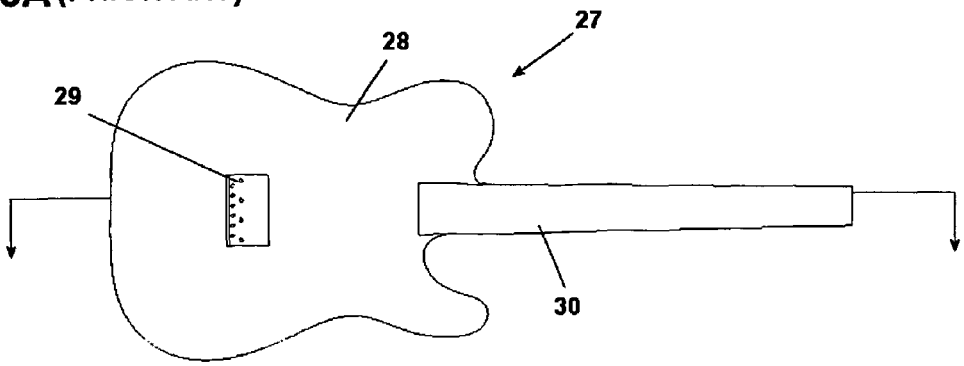
Fig. 13A (PRIOR ART)
Figure 13B:
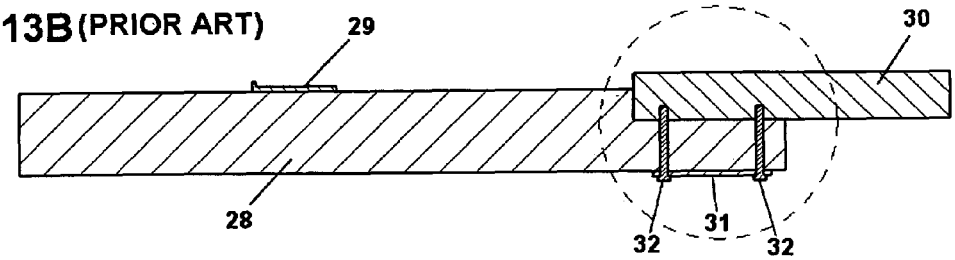
Fig. 13B (PRIOR ART)
Figure 13C:
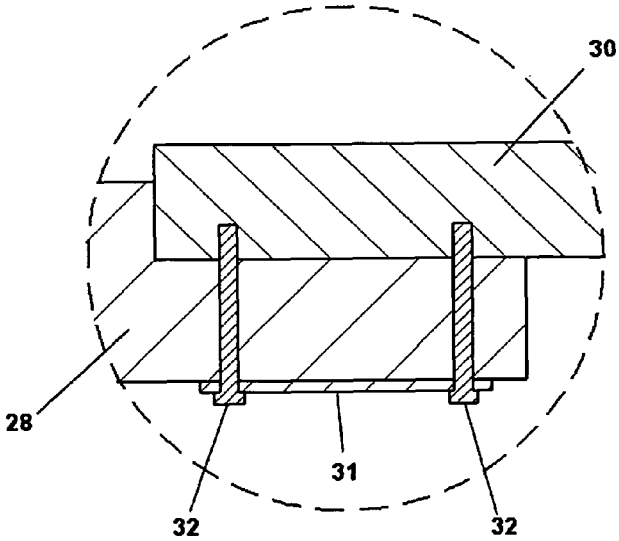
Fig. 13C (PRIOR ART)

FIG. 13A is a top view of conventional guitar 27 (prior art) showing location of cross sectional views in FIGS. 13B and 13C showing body 28, neck 30, and bridge 29.

FIG. 13B is sectional view of guitar 27 through section defined in FIG. 13A (prior art) showing body 28, neck 30, neck plate 31, neck mounting screws 32, and bridge 29.

FIG. 13C is enlarged sectional view of neck joint of conventional guitar 27 (prior art) showing body 28, neck 30, neck plate 31, and neck mounting screws 32.

Figure 14:
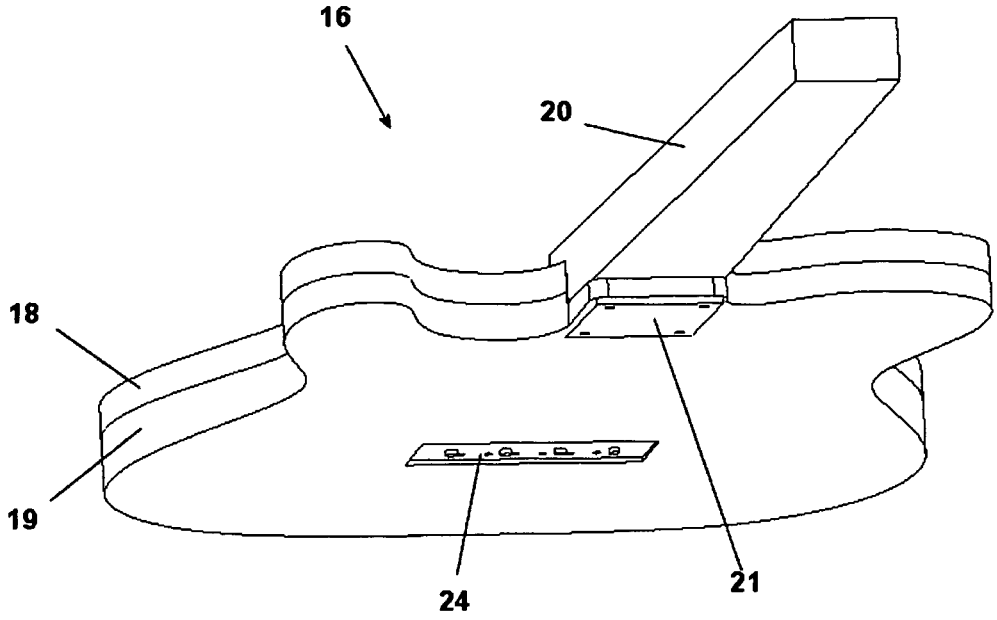

FIG. 14 is bottom front perspective view of guitar 16 according to invention showing body top 18, body bottom 19, neck 20, neck plate 21, and anchor block 24.

Figure 15:
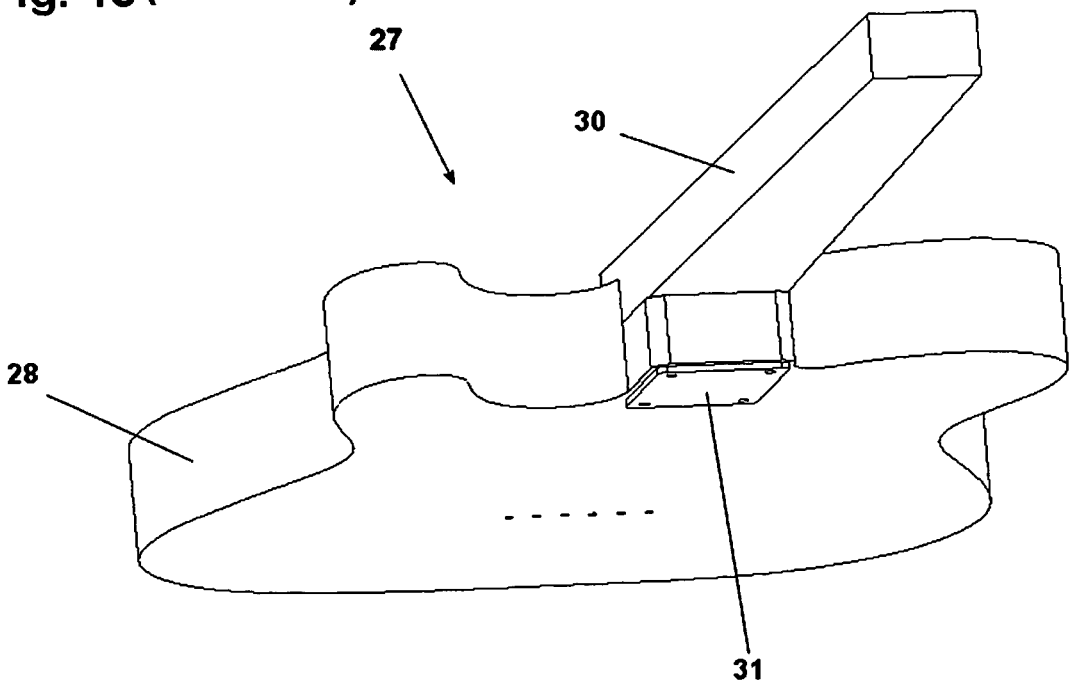
Fig. 15 (PRIOR ART)

FIG. 15 is bottom front perspective view of conventional guitar 27 (prior art) showing body 28, neck 30, and neck plate 31.

DETAILED DESCRIPTION OF INVENTION

The invention defines an assembly for a stringed instrument, such as an electric guitar 16 as shown in FIGS. 1-8 and 14. The guitar includes a body top 18, a body bottom 19, a neck 20, and a metal block 17 to connect the body top 18 and body bottom 19 to the neck 20. Strings, frets, pickups, headstock, pick guard and other mechanical/electronic parts are not shown but are well known in the art.

As shown in FIG. 5A, the metal block 17 consists of a main rectangular section 17F, the shape of which may vary depending on the overall design of the guitar 16, pickup locations (not shown), and type of bridge 22. The design shown in these drawings has holes 17D drilled in block 17 for the strings (not shown) to be mounted through the block 17. There are holes 17E drilled to mount the bridge 22 with bridge screws 23. To reduce weight, the center section 17A of the block 17 is hollowed out. The front section of the block, or tongue 17B, is lowered to form a lap joint with the neck 20.

The rear portion of the block 17 is secured to the body bottom 19 by anchor block 24. Anchor block 24 overlaps a routed section of the body bottom 19 and is secured by four anchor block screws 25.

The wood guitar body bottom 19 in FIG. 7 is routed 19C to fit the block 17 and is not routed in the center 19A to fill the hollowed section of the block 17A with wood. The front section of the body bottom 19D is routed to fit the neck 20 and the tongue 17B of the block 17. The rear routing 19B of the body bottom 19 is routed to fit the block 17, and anchor block 24. In this particular example, the body bottom is wedge shaped from the rear portion and thins toward the heel, resulting in a thin heel joint. Other shapes of the body bottom can achieve the same effect.

To summarize, my invention utilizes a metal block that connects the bridge to the neck of a guitar. The block fits into a routed area of the body. The increased strength of the neck joint created by the metal block allows the heel portion of the lap joint where the body overlaps the neck to be considerable thinner then a conventional solid body guitar. The thinner neck joint allows better access to the upper fret registers. Connecting the bridge to the neck joint with the metal body allows for better sustain.

CONCLUSIONS, RAMIFICATIONS, AND SCOPE

Previous designs in prior art require the body to be a certain thickness to fit the various connectors and achieve the desired effect of gaining access to the upper fret registers by contouring the heel joint. The added strength of the metal block of my invention allows the heel portion of the body to be considerably thinner, not contoured, but yet retain the wood body for aesthetic and tonal qualities. The metal block connecting the neck and bridge increases sustain. Due to the large surface area the block contacts the body allows the string vibrations to resonate through the wooden body to achieve the wood's tonal qualities.

The invention claimed is:

1. Guitar neck joint reinforcement comprising:

a body having an axis, a front and rear side, and a pocket formed in the front side; said body comprised of a body top and body bottom, said body top and body bottom having a front and rear sides; a neck having front and rear sides and a proximal end secured to the body along an axis; a bridge to anchor the strings on said body; said pocket in said body forming a lap joint with said neck; wherein an area of said body on an opposite side of said pocket overlaps with said neck and forms a heel; a metal block which connects said bridge to said neck; said metal block is sandwiched into a recessed area of said rear side of said body top and front side of said body bottom; said block provides a structural support for said lap joint with said neck; wherein said heel is aesthetically provided and can vary in thickness; said pocket in said body can vary in depth to eliminate heel area.

2. The block as claimed in claim 1 has a neck end and a body end.

3. The neck end of block as claimed in claim 2 wherein said block has a recessed area that fits into said pocket of said body.

4. The block as claimed in claim 1 wherein said block is connected to said neck with fasteners or glue.

* * * * *